US005322105A

United States Patent [19]

Meek

[11] Patent Number: 5,322,105

[45] Date of Patent: * Jun. 21, 1994

[54] COMBINED WIPER AND CLUB HEAD COVER

[75] Inventor: William Meek, Calabasas, Calif.

[73] Assignee: MacWillie's Golf Products, Inc., Los Angeles, Calif.

[ * ] Notice: The portion of the term of this patent subsequent to Sep. 15, 2009 has been disclaimed.

[21] Appl. No.: 105,863

[22] Filed: Aug. 11, 1993

Related U.S. Application Data

[60] Division of Ser. No. 904,702, Jun. 26, 1992, which is a continuation-in-part of Ser. No. 642,389, Jan. 17, 1991, Pat. No. 5,146,968.

[51] Int. Cl.[5] ..... A63B 57/00

[52] U.S. Cl. ..... 150/160; 206/315.4

[58] Field of Search ..... 150/160, 159; 206/315.4, 315.3

[56] References Cited

U.S. PATENT DOCUMENTS

| | | | |
|---|---|---|---|
| D. 210,138 | 2/1968 | Forst | D21/221 |
| D. 317,693 | 6/1991 | Jencks et al. | D6/608 |
| 2,471,169 | 5/1949 | Salzberg et al. | 150/159 X |
| 3,548,908 | 12/1970 | Koetting | 150/160 |
| 3,593,769 | 7/1971 | Spears | 150/160 |
| 3,821,976 | 7/1974 | Smith et al. | 150/160 |
| 3,831,652 | 8/1974 | Hyden et al. | 150/160 |
| 3,861,434 | 1/1975 | Harding | 150/160 |
| 3,938,570 | 2/1976 | Stewart | 150/160 |
| 4,498,579 | 2/1985 | Brick | 206/315.4 |
| 4,699,164 | 10/1987 | Pilney et al. | 150/160 X |
| 4,898,222 | 2/1990 | Gaffney | 150/160 |
| 4,971,126 | 11/1990 | Borenstein | 150/160 |
| 5,146,992 | 9/1992 | Meek | 206/315.4 X |

FOREIGN PATENT DOCUMENTS

| | | | |
|---|---|---|---|
| 2133700 | 8/1984 | United Kingdom | 150/160 |

OTHER PUBLICATIONS

Klub Kleen (Trademark) Product Consisting of a Towel with Attached Brush and Label (undated) Lakewood, Colo.

*Primary Examiner*—Sue A. Weaver
*Attorney, Agent, or Firm*—David Weiss

[57] ABSTRACT

A combined wiper and head cover for a golf club, including a club head scrubber, and the method of applying the cover to the club and in particular to a putter. The cover includes a towel section and a head-engaging section secured to the towel section for engaging the heel of the club head, and fastening means for releasably securing the head-engaging section to the club such that the towel section drapes from the toe of the club head and is substantially confined to one side of the club shaft when the club's head is positioned above its shaft.

13 Claims, 2 Drawing Sheets

Fig 7.
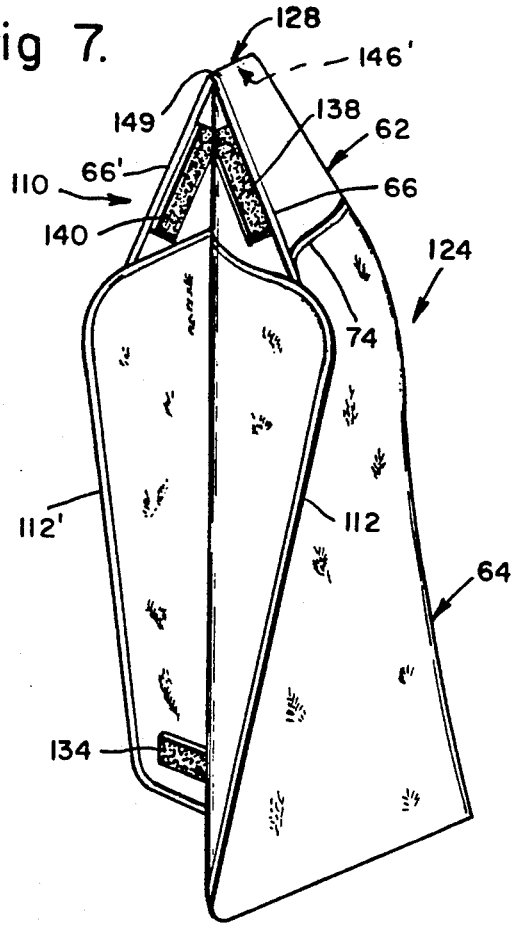
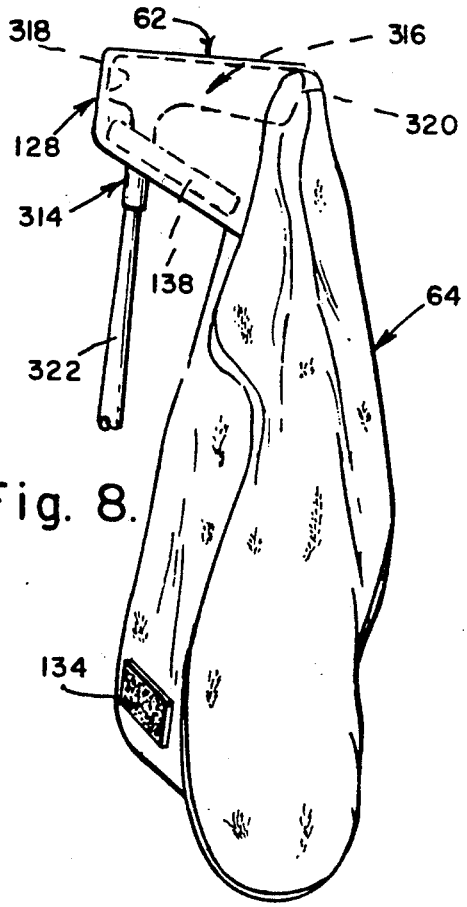
Fig. 8.
Fig. 9.
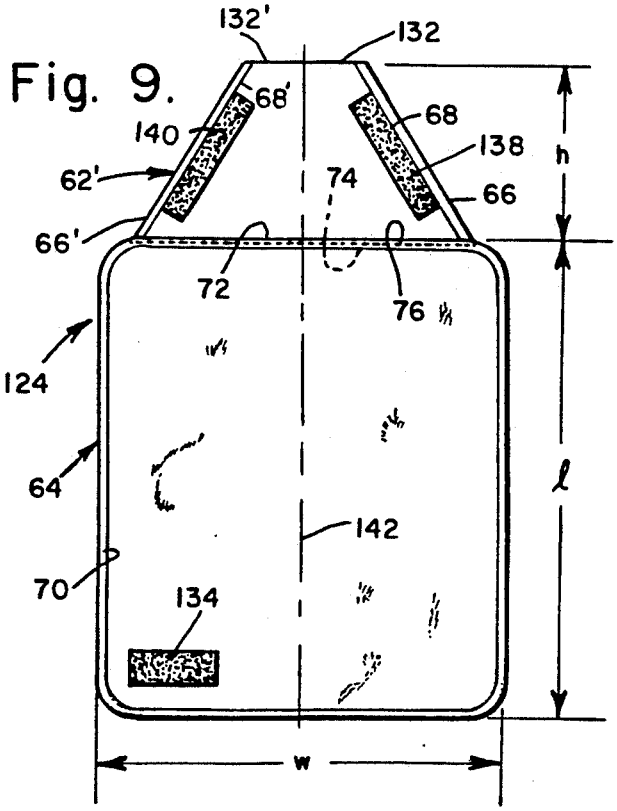
Fig. 10.
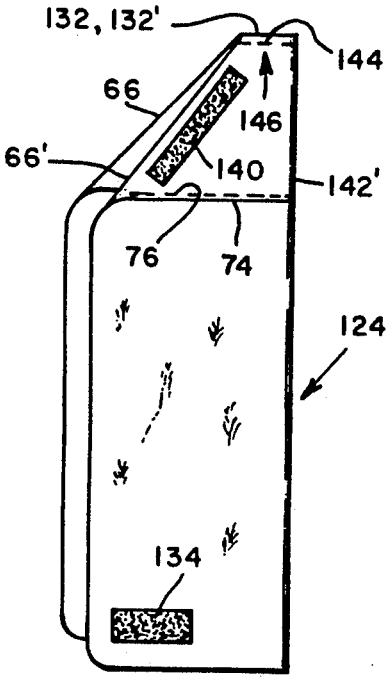

COMBINED WIPER AND CLUB HEAD COVER

CROSS REFERENCE TO RELATED APPLICATIONS

This application is a division of co-pending U.S. patent application Ser. No. 07/904,702, filed Jun. 26, 1992, which in turn is a continuation-in-part of U.S. patent application Ser. No. 07/642,389, filed Jan. 17, 1991, now U.S. Pat. No. 5,146,968, issued Sep. 15, 1992.

BACKGROUND OF THE INVENTION

This invention relates to covers for club heads, and more particularly to a head cover for a golf club which may conveniently be used as a wiper and scrubber for cleaning a golf ball or golf club, as well as to the method of applying the cover hereof to a golf club.

Although golf club head covers exist in various configurations for providing protection for golf club heads while the club is not in actual use, only a few have been developed which are intended to serve an additional purpose of permitting the golfer to utilize the cover as a wiper for cleaning the golf ball or the club during play. One such dual purpose club head cover is disclosed in U.S. Pat. No. 3,938,570, issued to Edra J. Stewart, in which it is pointed out that such dual purpose covers are particularly useful as a putter cover. When a golfer takes the putter to the putting green, he/she removes the dual purpose cover from the putter and may use it to wipe the ball and/or the putter prior to putting. The Stewart device, which is constructed of terry cloth or toweling, includes a head-engaging portion conforming to the configuration to the putter head, a narrowed "waist" portion which may be elasticized for grasping the club shaft, and an elongate skirt portion hanging loosely around a considerable portion of the length of the shaft of the club. The skirt portion may, alternatively, be fastened by VELCRO® fasteners or other quick fastening means on the skirt, for causing the skirt to furl around the club shaft when the club is not in use.

U.S. Pat. No. 3,831,652, issued to Alsie G. Hyden and Bill J. Blundell, discloses a combined putter head cover and towel, in which a boot-shaped sheath fits over the putter head and may include an elastic band for aiding in the retention of the boot on the putter head. A towel is secured about the peripheral edge of the boot's leg portion and is open along its length, apparently for hanging about the putter's shaft in a manner similar to the cover of the Stewart patent.

In each of these prior art devices, the head-engaging portion is shaped to the configuration of a particular type of putter head for fitting over the entire club head including the head's heel end and the club's distal toe end, and the towel portion substantially surrounds the putter's shaft. It would appear that such devices are not freely usable with different shapes and sizes of golf club heads, or even with different shapes and sizes of putter heads. Moreover, the circumstance of the towel's surrounding the shaft may interfere with the placing of the covered club in the golf club bag, as well as with the placing or withdrawing of other golf clubs in or from the bag containing the covered club. Further, the golfer would not conveniently be able to directly grasp the covered club by its shaft in the vicinity of the club head when withdrawing or replacing the club from or into the bag.

The foregoing disadvantages of prior art combined wiper and club head cover devices are overcome by means of the invention disclosed in the aforementioned co-pending U.S. Pat. No. 5,146,968, which patent is incorporated herein by reference. A combined wiper and club head cover device is disclosed therein which may be used with golf clubs having heads of various sizes or shapes, and which does not surround the club shaft but instead is disposed away from the shaft and drapes over an end of the club, so that the covered club may be positioned in the golf bag with the draped portion of the device disposed outside the periphery of the golf club bag. The manner in which the cover is disposed precludes interference with other clubs in the bag while permitting the covered club to be withdrawn from and returned to the golf club bag with ease and convenience not previously available with prior art combined wiper and head cover devices.

In describing the head cover of U.S. Pat. No. 5,146,968 as well as of the present invention, it is recognized that a club to be utilized with the head cover includes a head attached to a shaft, the head including two opposed ends conventionally referred to as the heel and the toe of the club head. The head cover of the parent application comprises a panel of pliant material such as cloth; means for engaging the panel with a first end of the club head such that the panel drapes from or over the second end of the club head when the club is vertically positioned with its head above its shaft; and means for releasably securing the panel to the club shaft with the engaging means the first end of the club head such that the draping panel extends away from the shaft and substantially confined to one side of the shaft. The panel, which is preferably of terry cloth or toweling material, includes an end-engaging portion inwardly extending from an edge of the panel, for engaging the first end of the club head; and the cover includes fastening means along the panel's edge in the vicinity of the panel's end-engaging portion, for releasably securing the panel to the club shaft with the end-engaging portion engaging the head's first end and with the panel covering the club head and draping over the head's second end when the club is vertically positioned with its head above its shaft.

As discussed in U.S. Pat. No. 5,146,968, the panel may be considered as including two edges joined at the end-engaging portion. The fastening means, which is preferably a quick-fastening and quick-release device such as cooperating strips of mating hooks and loops marketed under the trademark VELCRO, is situated at the panel edges in the vicinity of the end-engaging portion for releasably securing the panel to the club shaft with the end-engaging portion engaging the head's first end and with the panel covering the club head and draping over the second end of the head when the club is vertically positioned with the head above the shaft.

SUMMARY OF THE INVENTION

The combined wiper and club head cover of the present invention is an improvement of the combined wiper and club head cover disclosed in U.S. Pat. No. 5,146,968. In one manner of considering the improvement of the present invention, the panel of the parent application would include two sections, namely a first section which is preferably of a pliant plastic or leather material, and a second section which is preferably terry cloth or toweling material, or a towel. In accordance with this aspect of the present invention, a combined wiper and head cover is provided which comprises a pliant panel including a first panel section and a second panel section; means for engaging the first panel section with a first end of the club head such that the panel drapes over the second end of the club head when the club is vertically positioned with the head above the shaft; and means for releasably securing the panel to the club shaft with the first panel section engaging the first end of the club head such that the second panel section of the draping panel extends away from the shaft and is substantially confined to one side of the shaft.

The first section includes an end-engaging portion inwardly extending from an edge of the panel for engaging the first end of the club head, and fastening means is provided along such edge in the vicinity of the end-engaging portion for releasably securing the panel to the club shaft with the end-engaging portion engaging the head's first end and with the first section covering the club head and the panel draping over the second end of the head with the second section substantially confined to one side of the shaft when the club is vertically positioned with the head above the shaft. The edge along which the fastening means extends includes an edge of the first section for releasably securing the first section to the club shaft, and the fastening means extends generally toward the second end of the club head when securing the panel to the club shaft.

The panel may be considered as including two edges joined at the end-engaging portion of the first section, and preferably the two edges include edges of the first section; and the fastening means are at these edges in the vicinity of the end-engaging portion for releasably securing the panel to the club shaft with the end-engaging portion of the first section engaging the head's first end and with the panel covering the club head and the second section draping from the second end of the head when the club is vertically positioned with the head above the shaft.

According to another aspect of the present invention, the combined wiper and head cover comprises, in combination, a towel; head-engaging means secured to the towel for engaging a first end of the club head; and fastening means for releasably securing the head-engaging means to the club with the head-engaging means engaging the head's first end and extending over the head with the towel draping from a second end of the head and substantially confined to one side of the shaft when the club is vertically positioned with the head above the shaft. The club's first end is preferably its heel end, and the club's second end is preferably its distal toe end. Accordingly, the head-engaging means secured to the towel includes a heel-engaging portion for engaging the heel end of the club head; the fastening means releasably secures the head-engaging means to the club shaft with the heel-engaging portion engaging the heel end and the head-engaging means extending from the heel-engaging portion and covering the club head with the towel draping from the distal toe end and substantially confined to one side of the shaft when the club is vertically positioned with the head above the shaft.

An improvement feature of the present invention is the provision of scrubber means secured to the pliant panel, such as a scrubber patch secured to a side of the towel, for use in removing debris from the club head when the scrubber patch is rubbed thereover. The patch is preferably pliable and may be made of a plastic material capable of removing debris from the club head, such as a patch of plastic fastening material marketed under the VELCRO trademark.

The invention further comprises the combination of a golf club and the improved club wiper/cover. Such combination includes, for example, a golf club having a head and a shaft attached to the head, the head including a heel and an opposed toe end forward of the shaft; a towel; head-engaging means secured to the towel, the head-engaging means engaging the heel end of the club head and extending over the head with the towel draping from the toe end when the club is vertically positioned with the head above the shaft; and means releasably securing the head-engaging means to the club shaft and extending beneath the club head and away from the shaft generally toward the toe end for substantially confining the draping towel forwardly of the shaft.

Another aspect of the invention disclosed in the parent application and included herein, includes a method of covering a golf club head comprising the steps of providing a golf club having a head attached to a shaft, the head including a first end and an opposed second end; providing a panel of pliant material; engaging the panel with the first end of the head such that the panel covers the head and drapes over the head's second end when the club is vertically positioned with the head above the shaft; and releasably securing the panel to the shaft in the vicinity of the head such that the draping panel extends away from the shaft and is substantially confined to one side of the shaft. The club head's first end is preferably the heel end of the head and the second end is preferably the distal toe end of the head, and during the securing step the panel extends toward the distal toe end. The method further includes the steps of providing a golf bag for carrying the golf club with its head above its shaft; and placing the golf club with the panel secured thereto in the golf club bag with the club's head above its shaft and with the drape of the secured panel disposed peripherally outside the bag. An aspect of the method specifically includes the providing of the improved wiper and club cover disclosed herein.

BRIEF DESCRIPTION OF THE DRAWINGS

The novel features which are believed to be characteristic of the invention, together with further advantages thereof, will be better understood from the following description considered in connection with the accompanying drawings in which preferred embodiments of the invention are illustrated by way of example. It is to be expressly understood, however, that the drawings are for the purpose of illustration and description only and are not intended as a definition of the limits of the invention.

FIG. 7 is a perspective view of a preferred embodiment of an improved combined wiper and golf club cover according to the present invention;

FIG. 8 is a perspective view of the cover of FIG. 7 shown secured to a golf putter of the type shown in FIG. 5;

FIG. 9 is a plan view of a panel for constructing the cover of FIG. 7, prior to sewing; and FIG. 10 is a perspective view of the panel of FIG. 8, after sewing.

DESCRIPTION OF THE PREFERRED EMBODIMENT

Figure 1:
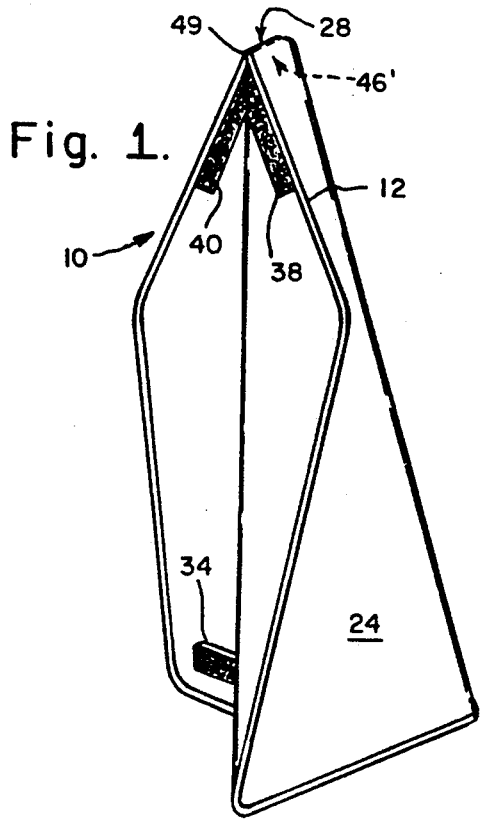
FIG. 1 is a perspective view of an embodiment of a combined wiper and golf club cover as disclosed in co-pending application Ser. No. 07/642,389, including one feature of the present invention.
Figure 2:
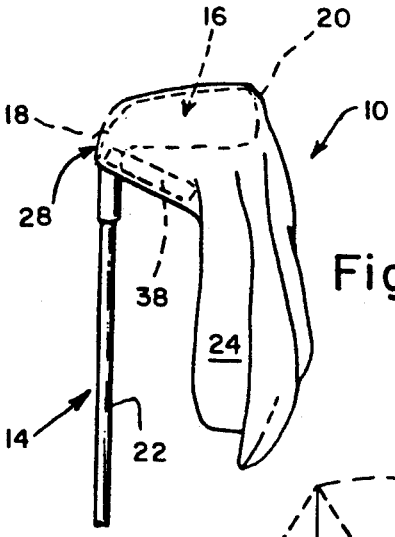
FIG. 2 is a perspective view of the cover of FIG. 1 shown secured to a golf putter in accordance with the method hereof.

Turning first to FIG. 1, a golf club head cover 10 of the type disclosed in the aforementioned U.S. Pat. No. 5,146,968, is shown with an edge 12 folded back for clarity of presentation, while the cover 10 is shown in FIG. 2 secured to a golf club 14 (which is a putter) and covering the club's head 16 (shown in phantom). The club's head 16 is conventionally regarded as having a heel end 18, positioned at the rear of the club 14 when being used by a golfer, and an opposed toe end 20 which is distant from the point of attachment of the head 16 to the golf club's shaft 22.

The cover 10 includes a panel 24 of pliant material, preferably a water absorbent cloth such as terry cloth or toweling, although absorbent paper with high tear strength or other disposable cloth-like materials may be employed.

The cover panel 24 includes an "end-engaging" or "heel-engaging" portion 28, for engaging a first end or the heel 18 of the club head 16. Use of the term "engaging the heel" is meant to connote that the portion 28 is intended to be placed at or about the heel end 18 of the club head 16, and it is not required that the portion 28 be in fitting contact with the heel end 18 although such is possible. The heel-engaging portion 28 shown in FIGS. 1 and 2 is configured for facilitating "engaging" the heel end 18 such that the panel 24 may be positioned to overlie and cover the club head 16 and to drape from or over the head's toe end 20 when the club 14 is positioned with its head 16 above its shaft 22 as shown in FIG. 2.

Figure 3:
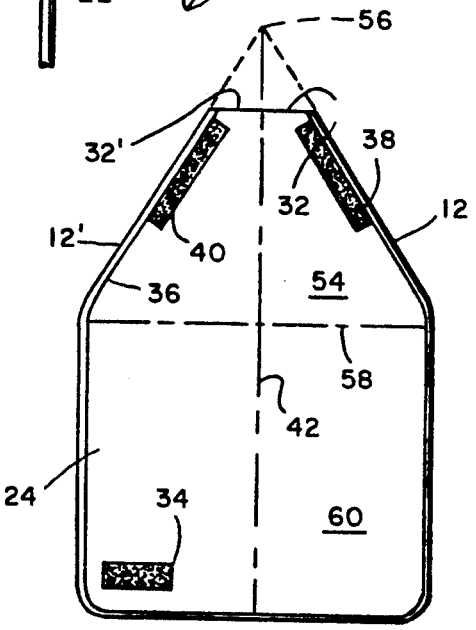
FIG. 3 is a plan view of a cloth panel for constructing the cover of FIG. 1, prior to sewing.

Fabrication of the cover 10 with its configured heel-engaging portion 28 is described with reference to FIGS. 3 and 4. FIG. 3 shows the cloth panel 24, which may be configured from a cloth sheet including an isosceles triangle 54 having a phantom base 58 forming a side of a depending rectangle 60, with the triangle's apex 56 (shown in phantom) cut to form a straight top side bisected by axis 42 to include equal segments 32, 32' each perpendicular to the bisecting axis 42. The edges 12, 12' may be hemmed, if desired, as indicated by the hem 36.

Strips of cooperating fastening material, such as marketed under the trademark VELCRO, are secured (such as by sewing) to the panel 24 at or along the edges 12, 12' respectively and equally spaced from the side segments 32, 32' so that the strips 38, 40 will mate when the panel 24 is folded along the axis 42 bisecting the panel 24. As is well known, VELCRO fasteners include a plastic hook device for mating with an included loop device when pressed into contact, so that the strip 38 may comprise the VELCRO hook device while the strip 40 may comprise the VELCRO loop device. In one example, the strips 38, 40 are sewn along the sides 12, 12' of the panel 24 with the space between the strips 38, 40 and their respective side segments 32, 32' at least sufficient to permit the sides 32, 32' to be sewn as later described (say at least approximately one-quarter or one-half inch), and the strips 38, 40 are approximately three and one-half inches in length, although the spacing and the strip dimensions may vary.

Figure 4:
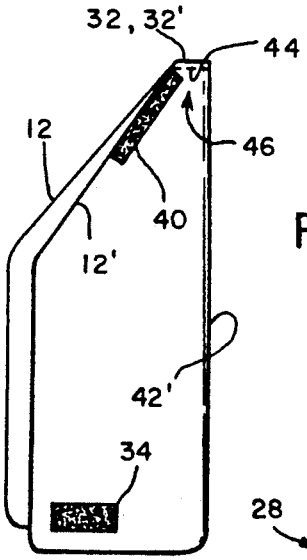
FIG. 4 is a perspective view of the panel of FIG. 3, after sewing.

To complete the fabrication of the cover 10, the panel 24 is folded along the fold line 42' corresponding to the axis 42, and the superposed side segments 32, 32' are secured together such as by sewing with stitches 44 for producing the pocket 46, as shown in FIG. 4. (It is noted that the edge seam 36 is not shown in FIG. 4 so that the stitches 44 may be clearly indicated.) After completion of such sewing, the panel 24 is turned inside out at the recess or pocket 46, resulting in the completed golf club head cover 10 shown in FIG. 1 with its heel-engaging portion 28 including the sewn edges 32, 32' and including its own recess or pocket 46' corresponding to the pocket 46 of FIG. 4. The remainder of the panel 24 may be considered as comprising a body portion extending from the heel-engaging portion 28. The panel's edges 12, 12' are joined at the heel-engaging portion 28 with the fastening strips 38, 40 secured to the panel at or along the edges 12, 12' respectively, in the vicinity of the heel-engaging portion 28 or from about the junction 49 of the edges 12, 12' and the sewn sides 32, 32'. An alternative manner of describing this feature of the cover 10 is to consider that the panel 24 includes a free edge (previously described as the two edges 12, 12'), with the heel-engaging portion 28 (or the pocket 46') inwardly extending from such edge, and the fastening strips 38, 40 being situated along such edge with the heel-engaging portion 28 (or the pocket 46') therebetween.

One of the improvement features included in the present invention is the provision of a scrubber patch 34 secured to the panel 24, such as sewn to one side (for example, the underside) of the panel 24, as indicated in FIGS. 1, 3 and 4. The scrubber patch 34 is of a material capable of removing debris from a club head when the panel is grasped and the patch 34 rubbed over the club head. The scrubber patch 34 is preferably of a pliable material which, together with the manner of its attachment to the panel 24, may be susceptible of being washed along with the cover 10, such as by means of a conventional clothes washing machine. One example of a suitable patch 34 is a pliable strip of somewhat abrasive plastic (e.g. Nylon ®) material such as VELCRO fastener material, and preferably the VELCRO hook fastener material. In an example of suitable dimensions of a scrubber patch 34, a three-inch long strip of one-inch wide VELCRO hook fastener material was found acceptable and may be conveniently positioned in a lower corner of the panel 24 as shown in the drawing.

The method of the invention may be illustrated as comprising the steps involved in applying the cover 10 to the golf club 14. Returning to FIG. 2, the heel-engaging portion 28 of the cover 10 is applied to the club head 16, engaging the heel end 18, i.e. the pocket 46' of the heel-engaging portion 28 is placed at the heel 18 such that the panel's body portion covers the head 16 and drapes over the head's distal toe end when the club is vertically positioned with its head 16 above its shaft 22. The two VELCRO fastening strips 38, 40, which are situated below the club head 16, are pressed together for being fastened to one another at and extending forwardly of the shaft 22. The panel 24 is thereby releasably secured to the shaft 22 in the vicinity of the head 16 in such manner that the panel 24 is urged to extend away from the shaft and generally toward the distal toe end 20 of the club head 16.

Figure 5:
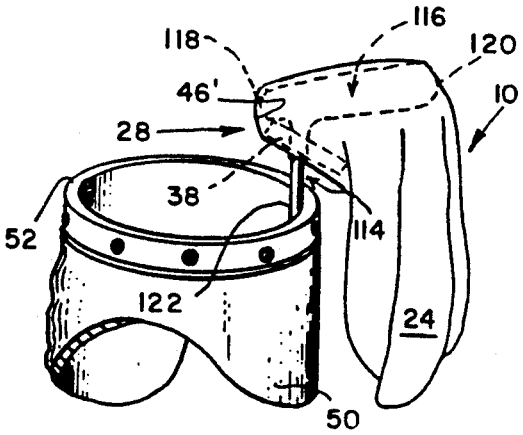
FIG. 5 is a perspective view of the cover of FIG. 1 shown secured to another type of golf putter, the putter positioned in a golf club bag in accordance with the method hereof.

The cover 10 and its manner of application to the club 14 cause the secured cover to extend away from and be confined to one side of the golf club shaft 22 as shown in FIG. 2. This permits the covered putter to be placed in a golf club bag in such manner that the hanging cloth panel 24 does not interfere with such placement, or with the placement or withdrawal of other golf clubs in or from the bag. Turning to FIG. 5, it may be appreciated that such results are accomplished by placing the putter with the panel 24 secured thereto in the golf club bag 50 with the putter's head above its shaft, and with the resulting drape of the secured panel 24 disposed outside the periphery 52 of the bag 50.

When withdrawing the covered putter from the golf bag, the golfer may grasp the club's shaft in the vicinity of the club's head without interference from the cover 10 which extends away from the club's shaft. At the putting green, the golfer removes the cover 10 from the putter by pulling apart or unfastening the mated VELCRO strips 38, 40. He/she may then use the cover to wipe the golf ball and/or the putter, and he/she may further use the scrubber patch 34 to clean debris from the putter head.

As indicative of the adaptability of the cover 10 for utilization with golf clubs having heads of different sizes and shapes, the golf club 114 of FIG. 5 is shown as having a head 116 of a popular type with a rearwardly protruding heel 118. The pocket 46' of the cover's heel-engaging portion 28 receives the club's protruding heel 118 with the panel 24 covering the head 116 and extending toward and draping over the putter's toe end 120. The head cover 10 is secured to the club shaft 122 by the VELCRO hook strip 38 being fastened to its mating loop strip 40 (not shown) forwardly and preferably rearwardly of the shaft 122, with the panel 24 extending away from the shaft 122 and generally toward the putter's toe end 120.

Figure 6:
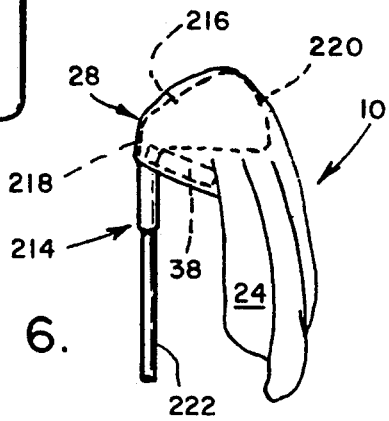
FIG. 6 is a perspective view of the cover of FIG. 1 secured to yet another type of golf club.

In similar manner, FIG. 6 shows yet another type of golf club 214, such as one of the clubs conventionally referred to as an iron, having a head 216 of a configuration different from that of a putter, upon which has been installed the head cover 10. For example, particular advantage would be realizable when the cover 10 is utilized with sand or chipping wedge types of golf clubs which are typically employed in situations wherein wiping the golf ball and/or the wedge head may be desirable. The heel-engaging portion 28 of the cover 10 engages the heel end 218 of the club head 216, covering the head 216 and extending toward and draping over the head's toe end 220. The cover 10 is secured to the club shaft 214 by the strip 38 being fastened to its mating strip 40 beneath the heel 216 and forwardly of the shaft 222, with the panel 24 extending away from the shaft 222 and generally toward the club's toe end 220.

A preferred embodiment of an improved combined wiper and club head cover 110 according to the present invention is shown in FIGS. 7, 8, 9 and 10, in which the last two digits of the three-digit reference numerals are utilized to identify elements corresponding to elements of FIGS. 1–6 which are identified by corresponding two-digit reference numerals.

Turning to FIG. 7, the improved golf club head cover 110 according to the present invention is shown with an edge 112 folded back for clarity of presentation. The cover 110 is shown in FIG. 8 secured to a golf club 314 (which is a putter, such as of the type shown in FIG. 5) and covering the club's head 316 (shown in phantom) and draping from the club head's toe end 320.

The cover 110 includes a panel 124 which in turn includes a first section 62 of a preferably pliant material and a second section 64 of a pliant material which may be used as a wiper and is different from the material of the first panel section 62. The first panel section is preferably of a material which is pliant and capable of providing suitable protection to a golf club head, such as leather or plastic materials (e.g. vinyl) or other leather-like materials, although stiff or non-pliable materials may be utilized for the first section 62 if desired. The pliant wiper material of the second section 64 is preferably a water absorbent cloth such as terry cloth or toweling, or a towel, including absorbent paper with high tear strength or other disposable or washable cloth-like or cloth materials.

The first section 62 is a "head-engaging" section, for engaging the club head 316, and includes an "end-engaging" or "heel-engaging" portion 128 for engaging the first end or heel 318 of the club head 316. The heel-engaging portion 128 is intended to be placed at or about the heel end 318 of the club head 316, and it is not required that the heel-engaging portion 128 be in fitting contact with the heel end 318 although such is possible. The head-engaging section 62 shown in FIGS. 7 and 8 is configured for facilitating engaging the heel end 318 and extending toward the club's toe end 320 such that the head-engaging section 62 may be positioned to overlie and cover the club head 316 with the pliable second section or towel 64 draping from the head's toe end 320 when the club 314 is positioned with its head 316 above its shaft 322 as shown in FIG. 8.

Fabrication of the improved cover 110 is described with reference to FIGS. 9 and 10. As shown in FIG. 9, the first or head-engaging section 62 may be constructed from a pliable vinyl sheet in the form of a truncated isosceles triangle 62' generally similar to the triangle 54 truncated as previously described with respect to FIG. 3. The straight top edge of the truncated triangle 62' (which will become the heelengaging section 62) is bisected by axis 142 to include equal segments 132, 132' substantially perpendicular to the bisecting axis 142. The sloping lateral edges 66, 66' of the truncated section 62' may be hemmed, if desired, as indicated by hems 68, 68'.

Strips of cooperating fastening material 138, 140, such as VELCRO as previously noted, are secured (such as by sewing) to the truncated section 62' at or along the edges 66, 66' respectively and equally spaced from the edge segments 132, 132' so that the strips 138, 140 will mate when the section 62' is folded along the bisecting axis 142. As previously discussed, VELCRO fasteners include a hook device for mating with a loop device when pressed into contact, so that the strip 138 may comprise the VELCRO hook device while the strip 140 may comprise the VELCRO loop device. The strips 138, 140 are sewn along the edges 66, 66' of the section 62' with the space between the strips 138, 140 and their respective edge segments 132, 132' at least sufficient to permit the edges 132, 132' to be sewn as later described (say at least approximately one-quarter inch, although such spaces may be substantially greater such as approximately one-inch or more but preferably not significantly greater than approximately one and one-half inches, as indicated in FIG. 9). The strips 138, 140, in an example of the cover 110 of FIG. 9, are approximately four inches in length and five-eighth inch in width, although the strip dimensions (as well as their spacing from the edge segments 132, 132') may vary.

The second section 64 of the cover 110 may be generally rectangular, and preferably longer in length l than in width w, and its edges may be hemmed, if desired, as indicated by the hem 70. The second panel 64 is secured along its top edge 72 (as viewed in FIG. 9) to the base edge 74 of the truncated section 62', for example by means of sewing the substantially superposed edges 72, 74, as indicated by stitches 76. As previously noted, the second section 64 may comprise a towel such as of terry cloth or toweling material.

In one suitable example of the combined wiper and golf club head cover embodiment 110 of FIG. 9, the length l of the towel section 64 was approximately eighteen inches while its width w was approximately fifteen inches. In that example, the truncated isosceles triangle 62' of the first section 62 (as shown in FIG. 9) included a base 74 of approximately ten and one-half inches in width, a top edge width (the summation of top edge segments 132, 132') of approximately four and one-half inches, and a height h of approximately five inches.

A scrubber patch 134, in accordance with a feature of the present invention, is secured to the second section or towel 64 of the cover 110. The scrubber patch 134 is of a material capable of removing debris from a club head, such as when the cover 110 is removed from the club head and the second section or towel 64 is grasped by a golfer or caddie and the patch 134 rubbed over the club head. As previously noted, the scrubber patch 134 is preferably of a pliable material which, along with the manner of its attachment to the towel 64, may be susceptible of being washed along with the cover 110. A pliable strip of somewhat abrasive plastic material, such as a VELCRO fastener device (preferably the hook device), sewn to the towel 64 (e.g. to its underside in the vicinity of a lower corner thereof as viewed in FIG. 9), suitably accomplishes these purposes. The dimensions of a suitable example of a scrubber patch 134 for the cover 110 shown in FIG. 9 was approximately three inches in length by approximately one-inch in width.

To complete the fabrication of the cover 110, the truncated section 62' is folded along the fold line 142' corresponding to the axis 142, and the superposed edge segments 132, 132' are secured together such as by sewing with stitches 144 for producing a pocket 146, as shown in FIG. 10. (It is noted that the edge seams 66, 66' are not shown in FIG. 10 so that the stitches 144 may be clearly indicated.) After completion of such sewing, the panel 124 is turned inside-out at the recess or pocket 146, resulting in the completed golf club head cover 110 shown in FIG. 7 with its first or head-engaging section 62 having its heel-engaging portion 128 including the sewn edges 132, 132' and its own recess or pocket 146' corresponding to the pocket 146 of the FIG. 10. The edges 66, 66' of the first section 62 are joined at the heel-engaging portion 128 with the fastening strips 138, 140 secured to the first section 62 at or along the edges 66, 66' respectively, in the vicinity of the heel-engaging portion 128, equally spaced or approximately extending from the junction 149 of the lateral edges 66, 66' and the sewn top edges 132, 132'. An alternative manner of describing this feature of the head-engaging section 62 is to consider that the panel 124 (preferably the panel's first section 62) includes a free edge (previously described as the two edges 66, 66') with the heel-engaging portion 128 (or the pocket 146') inwardly extending from such free edge and the fastening strips 138, 140 situated along such free edge with the heel-engaging portion 128 (or the pocket 146') therebetween.

In applying the improved head cover 110 to the method of the invention, and returning to FIG. 8, the heel-engaging portion 128 of the head-engaging section 62 of the cover 110 is applied to the club head 316 and engaging the heel end 318, i.e. the pocket 146' of the head-engaging section 62 is placed at the heel 318 such that the head-engaging section 62 extends toward the club's toe end 320 and covers the head 316 with the panel's second section or towel 64 draping from the head's toe end 320 when the club 314 is vertically positioned with its head 316 above its shaft 322. The two VELCRO fastening strips 138, 140, which are situated below the club head 316, are pressed together for being fastened to one another and extend forwardly of the shaft 322. The panel's first section 62 is thereby releasably secured to the shaft 322 in the vicinity of the head 316 in such manner that the first section 62 is urged to extend away from the shaft 322 and generally toward the distal toe end 320 of the club head 316.

The cover 110 and its manner of application to the club 314 cause the second section or towel 64 to extend away from the golf club shaft 322 and to be substantially confined to one side of the shaft 322, as shown in FIG. 8. This permits the covered putter 314 to be placed in a golf club bag in such manner that the hanging portion of the cover 110 (i.e. the towel 64) does not interfere with such placement, or with the placement or withdrawal of other golf clubs in or from the bag. Such results may be accomplished by placing the putter 314 with the cover's head-engaging section 62 secured thereto in the golf club bag with the putter's head 316 above its shaft 322 and with the resulting drape of the pliable second section or towel 64 disposed outside the periphery of the bag, as may be appreciated from FIG. 5.

When withdrawing the covered putter from the golf bag, the golfer may grasp the club shaft in the vicinity of the club's head without interference from the cover 110 which extends away from the club'shaft. At the putting green, the golfer removes the cover 110 from the putter by pulling apart the edges 66, 66', which in turn pulls apart and unfastens the mating VELCRO strips 138, 140. He/she may then use the cover to wipe the golf ball or the putter, and he/she may further use the scrubber patch 134 to clean debris from the putter head.

It may be appreciated that the cover 110 may be utilized with golf clubs having heads of different sizes and shapes, in addition to the type of putter shown in FIG. 8, in the same manner as the cover 10 is shown with such other clubs in FIGS. 2 and 6.

Thus, there has been described a combined wiper and golf club head cover, including a scrubber patch feature, and a method of utilizing the same. Other embodiments and configurations of the wiper/cover and scrubber of the present invention, and of methods for their utilization, may be developed without departing from the essential characteristics thereof. For example, it should be recognized that although VELCRO fastening means are preferred, other types of fastening means for releasably securing the cover to the club shaft may be utilized, such as mating snaps or zippers or button/button hole arrangements. Accordingly, the invention should be limited only by the scope of the claims listed below.

I claim:

1. A combined wiper and head cover for a club having a head attached to a shaft, the head including a first end and an opposed second end, the combined wiper and head cover comprising:

a pliant panel including a first panel section and a second panel section;

means for engaging said first panel section with the first end of the club head such that said panel drapes over the second end of the club head when the club is vertically positioned with the head above the shaft; and means for releasably securing said panel to the club shaft with said first panel section engaging the first end of the club head such that said second panel section of said draping panel extends away from the shaft and is substantially confined to one side of the shaft.

2. A combined wiper and head cover for a golf club having a head attached to a shaft, comprising in combination a panel including a first section of a pliant material and a second section of a pliant material, said first section having an end-engaging portion inwardly extending from an edge of said panel for engaging a first end of the club head; and fastening means along said edge in the vicinity of said end-engaging portion for releasably securing said panel to the club shaft with said end-engaging portion engaging the head's first end and with said first section covering the club head and said panel draping over a second end of the head with said second section substantially confined to one side of the shaft when the club is vertically positioned with the head above the shaft.

3. The combined wiper and head cover according to claim 2, wherein said edge along which said fastening means extends includes an edge of said first section for releasably securing said first section to the club shaft.

4. The combined wiper and head cover according to claim 2, wherein said edge along which said fastening means extends includes an edge of said first section, and said fastening means extends generally toward the second end of the club head when securing said panel to the club shaft.

5. The combined wiper and head cover according to claim 2, wherein said fastening means includes two cooperating fastening devices secured at said edge with said end-engaging portion between said two fastening devices.

6. The combined wiper and head cover according to claim 2, wherein said pliant material of said second section is absorbent.

7. A combined wiper and head cover for a golf club having a head attached to a shaft, comprising in combination a panel including a first section of a pliant material and a second section of a pliant material, said first section having an end-engaging portion for engaging a first end of the club head, said panel including two edges joined to one another at said end-engaging portion; and fastening means at said edges in the vicinity of said end-engaging portion for releasably securing said panel to the club shaft with said end-engaging portion of said first section engaging the head's first end and with said panel covering the club head and said second section draping from a second end of the head when the club is vertically positioned with the head above the shaft.

8. The combined wiper and head cover according to claim 7, wherein said panel is urged away from the shaft and generally toward the head's second end by said fastening means securing said panel to the shaft with said end-engaging portion engaging the head's first end.

9. The combined wiper and head cover according to claim 7, wherein said two edges of said panel are along said first section.

10. A combined wiper and head cover for a golf club having a head attached to a shaft comprising:

a towel;

head-engaging means secured to said towel for engaging a first end of the head; and fastening means for releasably securing said head-engaging means to the club when said head-engaging means is engaging the head's first end and extending over the head with said towel draping from a second end of the head and substantially confined to one side of the shaft when the club is vertically positioned with the head above the shaft.

11. A combined wiper and head cover for a club having a head attached to a shaft, the head including a heel end and a distal toe end, comprising in combination:

a towel;

head-engaging means secured to said towel and including a heel-engaging portion for engaging the heel end of the club head;

fastening means for releasably securing said head-engaging means to the club shaft with said heel-engaging portion engaging the heel end;

said head-engaging means extending from said heel-engaging portion for covering the club head with said towel draping from the distal toe end and substantially confined to one side of the shaft when said head-engaging means is secured to the shaft by said fastening means and the club is vertically positioned with the head above the shaft.

12. Golf club and cover apparatus, comprising in combination:

a golf club having a head with a first end and an opposed second end, and a shaft attached to said head;

a towel;

head-engaging means secured to said towel and engaging said first end of said club head with said head-engaging means extending over said head such that said towel drapes from said second end when said club is vertically positioned with said head above said shaft; and means releasably securing said head-engaging means to said club shaft and urging said head-engaging means to extend away from said shaft and generally toward said second end.

13. Golf club and cover apparatus, comprising in combination:

a golf club having a head and a shaft attached to said head, said head including a heel end and an opposed toe end forward of said shaft;

a towel;

head-engaging means secured to said towel, said head-engaging means engaging said heel end of said club head and extending over said head with said towel draping from said toe end when said club is vertically positioned with said head above said shaft; and means releasably securing said head-engaging means to said club shaft and extending beneath said club head and away from said shaft generally toward said toe end for substantially confining said draping towel forwardly of said shaft.

* * * * *